US005827004A

United States Patent [19]

Kim

[11] Patent Number: 5,827,004

[45] Date of Patent: Oct. 27, 1998

[54] SLIDING LOOSE LEAF BINDER

[76] Inventor: Dong Chan Kim, 465 S. Madison Ave. #118, Pasadena, Calif. 91101

[21] Appl. No.: 791,359

[22] Filed: Jan. 30, 1997

[51] Int. Cl.[6] ..... B42F 3/02

[52] U.S. Cl. ..... 402/46; 402/56; 402/39

[58] Field of Search ..... 402/46, 48, 52, 402/55, 56, 49, 39

[56] References Cited

U.S. PATENT DOCUMENTS

| | | | |
|---|---|---|---|
| 936,448 | 10/1909 | Hamacher . | |
| 1,786,617 | 12/1930 | Hutchings | 402/55 |
| 1,840,743 | 1/1932 | Schade . | |
| 2,377,179 | 5/1945 | Pitt . | |
| 3,348,550 | 10/1967 | Wolf et al. | 402/56 |
| 3,833,308 | 9/1974 | Seaborn | 402/56 |
| 4,552,478 | 11/1985 | Cohen . | |
| 4,582,442 | 4/1986 | Rager | 281/29 |
| 4,743,134 | 5/1988 | Reinherz et al. . | |
| 5,281,040 | 1/1994 | Hodkin et al. . | |
| 5,667,324 | 9/1997 | Aoki | 402/46 |

FOREIGN PATENT DOCUMENTS

| | | | |
|---|---|---|---|
| 0582159 | 5/1924 | France | 402/56 |

*Primary Examiner*—Frances Han

[57] ABSTRACT

A sliding loose leaf binder having a fixed part and a movable part is provided. The fixed part comprises a first base member, a plurality of mounting apertures, a plurality of a first top and bottom members of mating tracks, a plurality of first ring elements, and first elements of releasable locking means. The movable part comprises a second base member, a plurality of second top and bottom members of mating tracks, a plurality of second ring elements, and second elements of releasable locking means.

The sliding loose-leaf binder can be open or closed by sliding the movable part in or out toward the fixed part along the mating tracks.

15 Claims, 7 Drawing Sheets

SLIDING LOOSE LEAF BINDER

BACKGROUND OF INVENTION

1. Field of the Invention

The present invention relates to loose leaf binders. Specifically, the present invention relates to a sliding loose leaf binder having a fixed part for mounting on a folder and a movable part for slidably moving between open and closed positions.

2. Prior Art

Currently, there are a wide range of conventional binder constructions available in the marketplace. The most common forms of such binders are O-ring, and D-ring binders. However, these binders generally have major drawbacks. They make a loud clapping sound when close, which is not desirable if one is attending at a quite class room or a conference room. The sharp teeth on a ring element could bite a finger for inadvertent users. For the O-ring binders, they tend to jam loose leaves that are placed below the bottom portions of ring elements. Another drawback for O-ring and D-ring binders is that the height of spine side is generally larger than the height of opposite side for empty or partially filled binders so that it is hard to shelf a plurality of these binders adjacently. Even if these binders are successfully shelved, they tend to fall easily due to their unstable shape. Present invention is proposed to solve these problems.

SUMMARY OF THE INVENTION

The object of the present invention is to provide a quite operation of binder when open and close. This object can be achieved by unique sliding operation of the present invention that has a fixed part for mounting on a folder and a movable part for slidably moving between open and closed positions.

Another object of the present invention is to prevent jamming of loose leaves that are placed below the bottom portions of binder ring elements. This object can be achieved by adopting a unique ring construction.

A further objective of the present invention is to provide a binder that has a book-like boxy shape so that a plurality of these binders can be shelved adjacently without tendency of falling.

DETAILED DESCRIPTION OF THE PREFERRED EMBODIMENT

Figure 1:
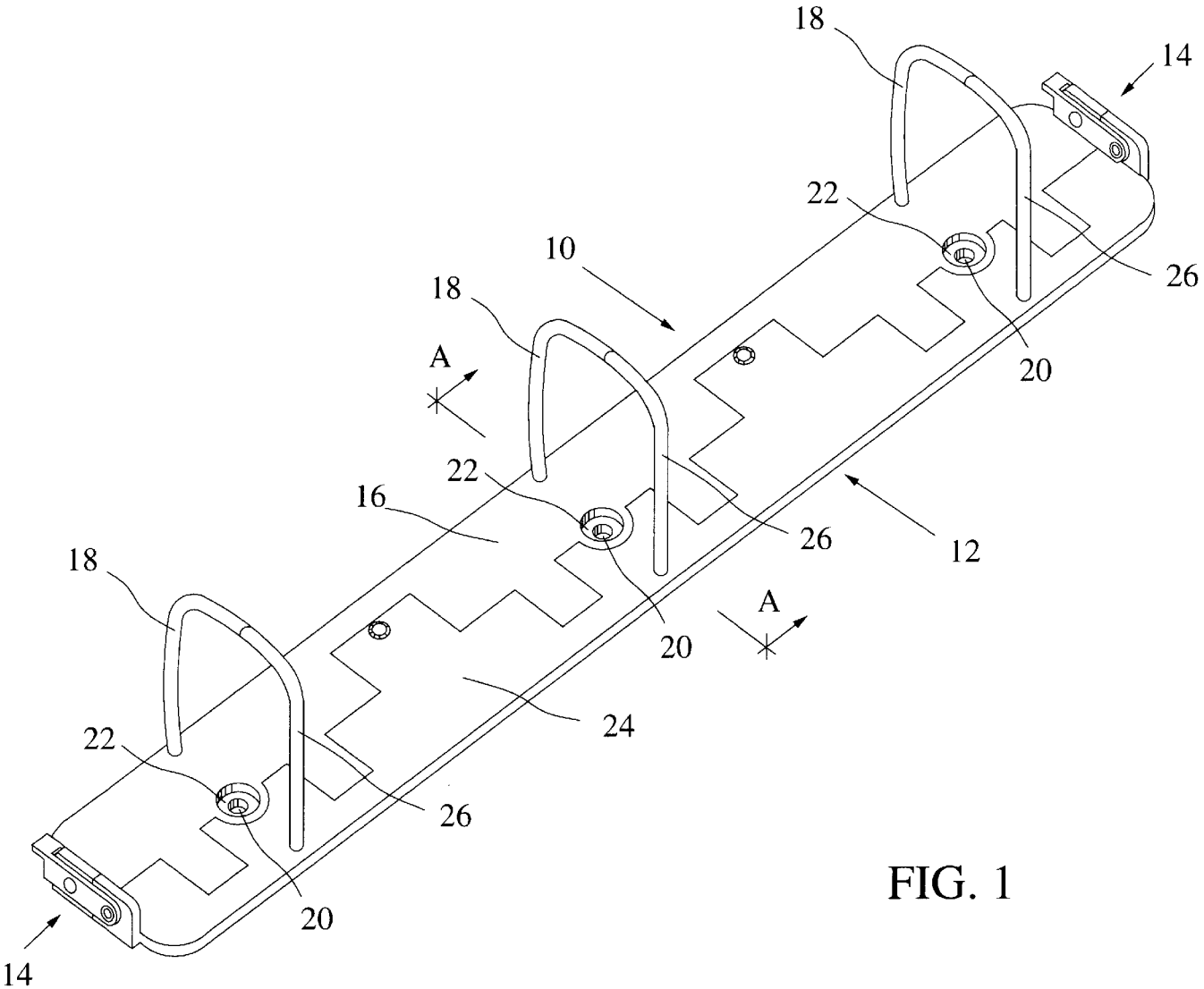
FIG. 1 is a perspective view of the sliding loose leaf binder in a closed position.

FIG. 1 shows a sliding loose leaf binder in a closed position. The sliding loose leaf binder comprises a fixed part 10, a movable part 12, and releasable locking means 14, 14. The fixed part 10 comprises a generally flat elongated first base member 16, first ring elements 18, 18, 18, mounting apertures 20, 20, 20, and aperture rims 22, 22, 22. The mounting apertures 20, 20, 20 are provided to mount a fixed part 10 on a folder with fasteners such as rivets, and the encircling aperture rims 22, 22, 22 are provided to accommodate rivet head. The movable part 12 comprises a generally flat elongated second base member 24, and second ring elements 26, 26, 26.

Figure 2:
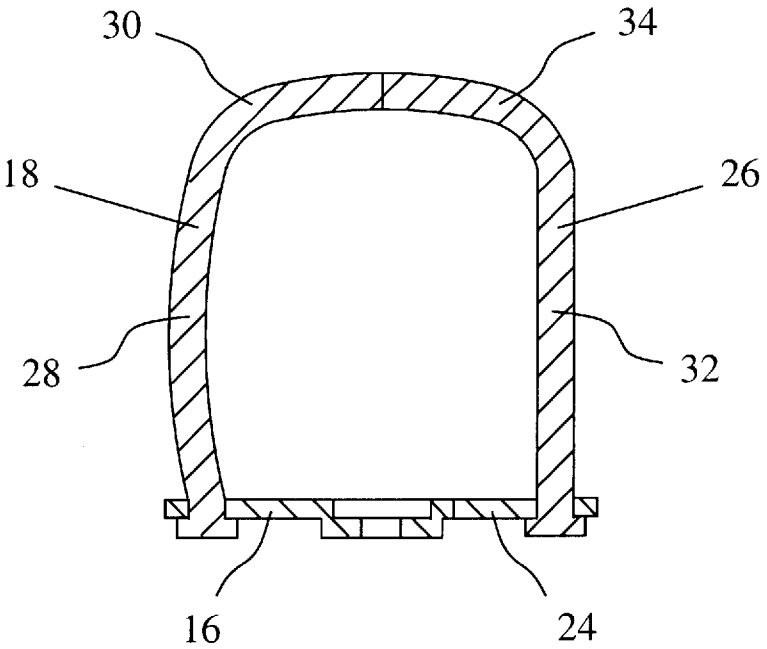
FIG. 2 is an enlarged cross sectional view taken generally along line A—A of FIG. 1.

FIG. 2 shows an enlarged cross sectional view taken generally along line A—A of FIG. 1. The first ring element 18 comprises an arcuate portion 28 and a first top portion 30. The arcuate portion 28 is slightly curved outwardly forming flattened arch shape. The first top portion 30, which is extending from the upper end of the arcuate portion 28, extends laterally forming one half of a flattened arch shape. The second ring element 26 comprises a straight portion 32 and a second top portion 34. The straight portion 32 is vertically straight with respective to the plane of the second base member 24. The second top portion 34, which is extending from the upper end of the straight portion 32, extends laterally forming another half of a flattened arch shape. The first top portion 30 and the second top portion 34 is symmetrical about a longitudinal plane. The straight portion 32 and the second top portion 34 together form one half of U-shape. The bottom ends of the arcuate portion 28 and the straight portion 32 are fixedly attached to the first base member 16 and to the second base member 24 respectively.

Figure 3:
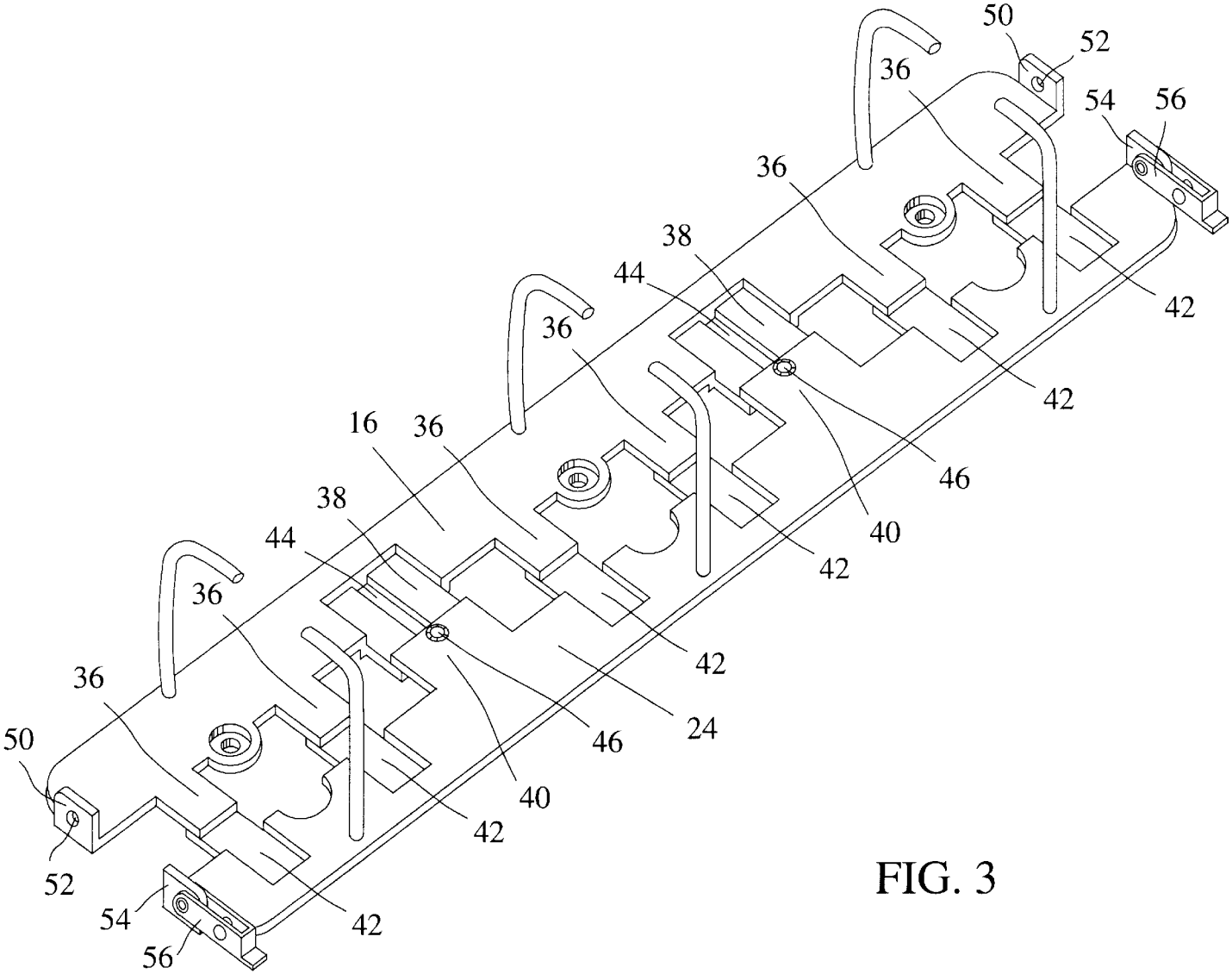
FIG. 3 is a perspective view of the sliding loose leaf binder in a fully opened position.
Figure 4:
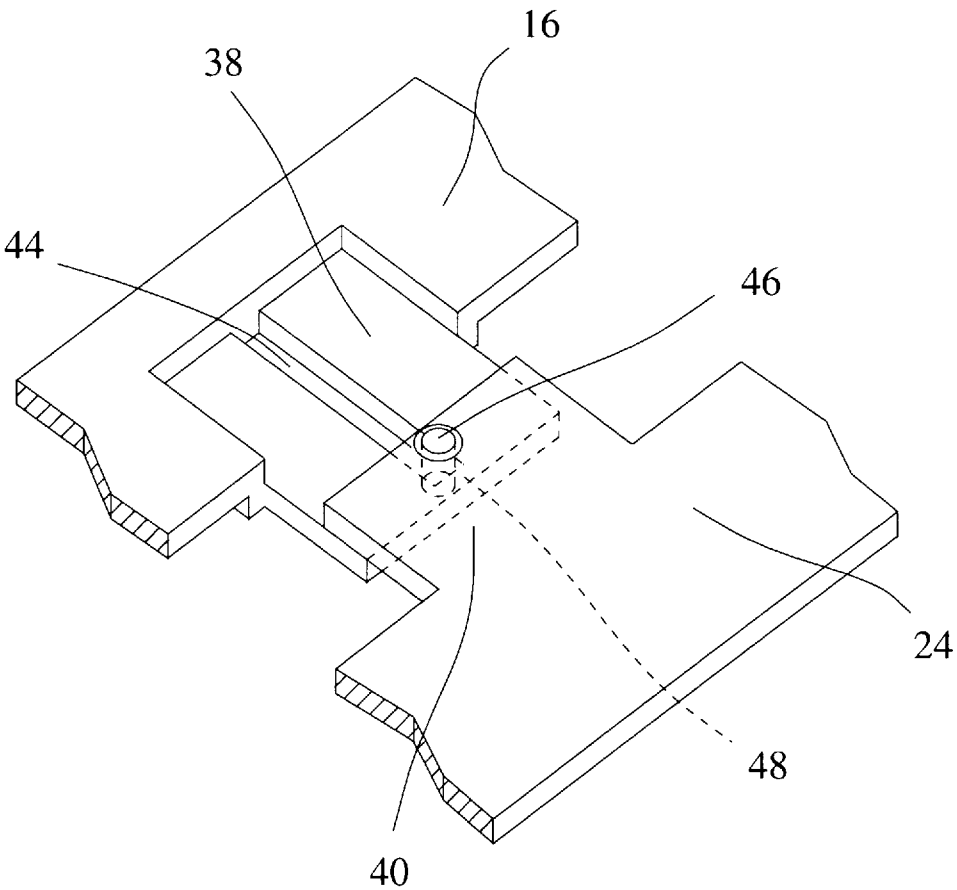
FIG. 4 is an enlarged perspective view of the mating tracks of the sliding loose leaf binder of FIG. 3.

FIG. 3 shows a sliding loose leaf binder in a fully opened position. As shown, the present invention comprises a plurality of mating tracks. The first base member 16 comprises first top members of mating tracks 36, 36, 36, 36, 36, 36 and first bottom members of mating tracks 38, 38. The second base member 24 comprises second top members of mating tracks 40, 40 and second bottom members of mating tracks 42, 42, 42, 42, 42, 42. The first top members of mating tracks 36, 36, 36, 36, 36, 36 are flat and rectangular extending horizontally from right end of the first base member 16 toward the second base member 24, and the second top members of mating tracks 40, 40 are flat and rectangular extending horizontally from left end of the second base member 24 toward the first base member 16. The first bottom members of mating tracks 38, 38 and the second bottom members of mating tracks 42, 42, 42, 42, 42, 42 are flat and rectangular and can preferably be formed by a pressing function to a depth of about 0.5 to 3 millimeters. About a half of the first bottom members of mating tracks 38, 38 belongs to the first base member 16 and another half extends horizontally toward the second base member 24. Similarly, about a half of the second bottom members of mating tracks 42, 42, 42, 42, 42, 42 belongs to the second base member 24 and another half extends horizontally toward the first base member 16. The first bottom members of mating tracks 38, 38, have guiding slots 44, 44 and the second top member of mating tracks 40, 40 have guiding rods 46, 46. As shown in FIG. 4, the guiding slots 44, 44 are substantially longitudinal and the guiding rods 46, 46 are cylindrical. The combination of the guiding slots 44, 44 and the guiding rods 46, 46 prevent a sidewise shifting of the movable part 12 relative to the fixed part 10, and guide the top members of mating tracks to mate properly to their corresponding bottom members of mating tracks. As shown, the right-hand end of the guiding slot 44 has a closed portion 48. At fully opened position, the closed portion 48 catches the guiding rod 46 to prevents the movable part 12 from sliding out of the fixed part 10.

Figure 5:
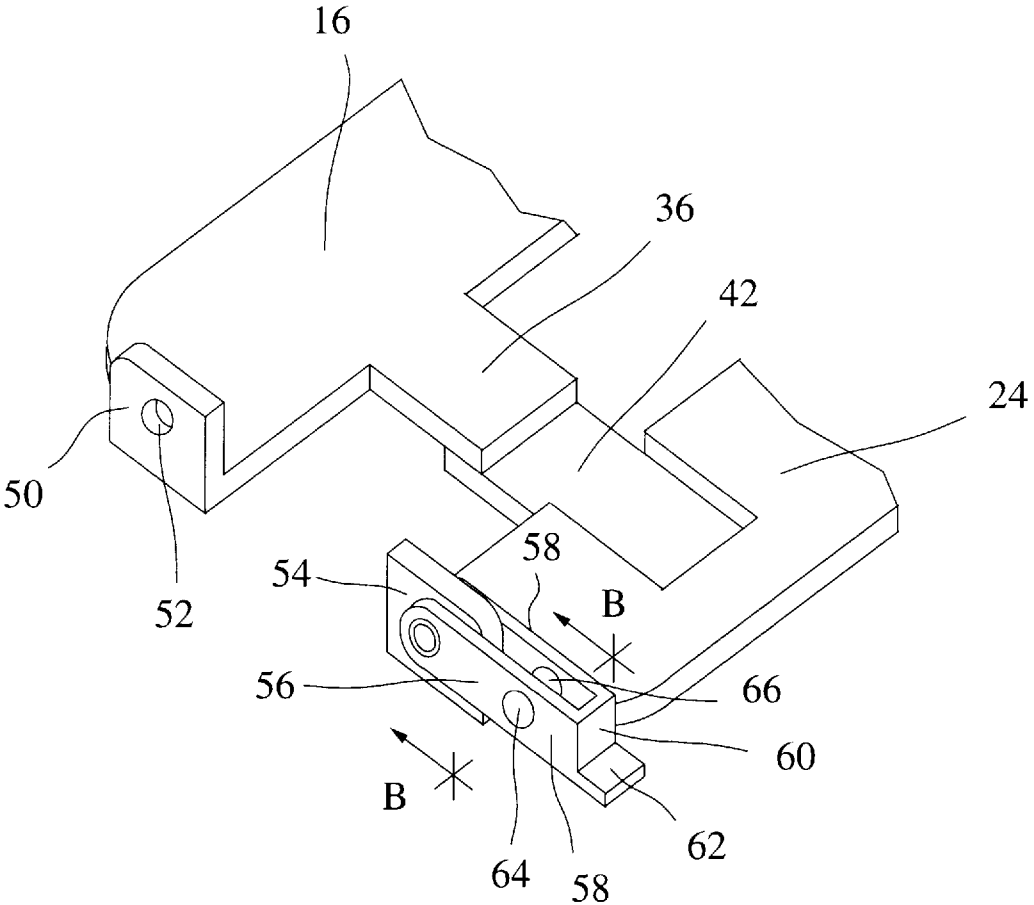
FIG. 5 is an enlarged perspective view of the releasable locking means of the sliding loose leaf binder of FIG. 3.
Figure 6:
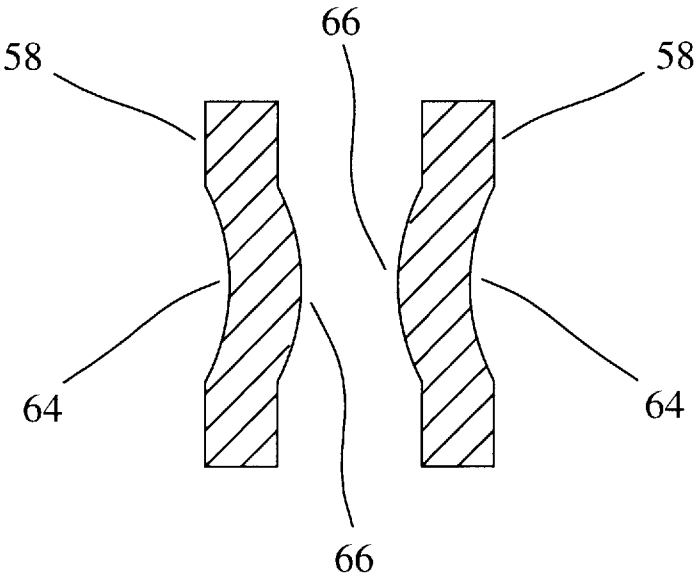
FIG. 6 is an enlarged cross sectional view taken generally along line B—B of FIG. 5.

Vertically extended from each lower and upper end of the first base member 16 are first elements of releasable locking means 50, 50. The first elements of releasable locking means 50, 50 are flat and rectangular with one rounded corner, and comprise receiving apertures 52, 52. Similarly, vertically extended from each lower and upper end of the second base member 24 are second elements of releasable locking means 54, 54. The second elements of releasable locking means 54, 54 are also flat and rectangular with one rounded corner, and comprise swingable engaging means 56, 56. As shown in FIG. 5, an elongated boxy shape of the swingable engaging means 56 has side portions 58, 58 and front portion 60. Extending from the bottom end of the front portion 60 at a right angle is a lug 62, provided for easy engagement or release of the swingable engaging means 56. Each of the side portion 58 comprises a dimple 64 on outside surface and a button 66 on inside surface. The dimple 64 is a concave shape and the button 66 is a convex shape. FIG. 6 shows an enlarged cross sectional view taken along line B—B of FIG. 5 where the concave shape of the dimples 64, 64 and the convex shape of the buttons 66, 66 are clearly illustrated. The swingable engaging means 56 can be engaged or released by angular movement. The receiving aperture 52 receives the buttons 66, 66 to secure the swingable engaging means 56 into an engaged or locked position.

Figure 7:
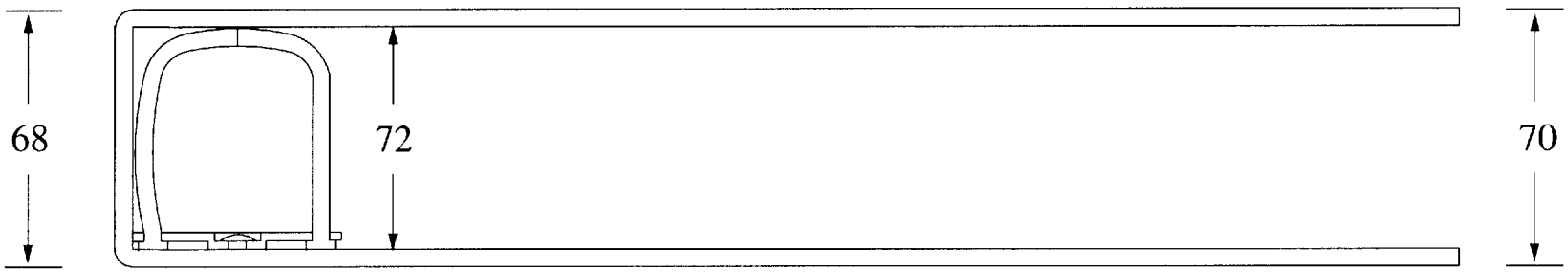
FIG. 7 is a sectional view of the sliding loose leaf binder of FIG. 1 mounted on a folder.

FIG. 7 is a sectional view of the sliding loose leaf binder of FIG. 1 mounted on a folder. Generally, the height of spine side 68 is larger than the height of opposite side 70 for an empty or partially filled conventional binders, and the sectional view of the these binders is either triangular or trapezoidal. Because of their shape, a plurality of empty or partially filled binders can't be adjacently shelved on a bookshelf and tend to fall easily. By appropriately choosing the height of the ring 72, it is always possible to equalize the height of spine side 68 and the height of opposite side 70 so that the overall shape of the sliding loose-leaf binder to form a book-like boxy shape. So, irrespective of whether it is an empty or partially-filled binders, it is possible to shelf a plurality of binders on a bookshelf adjacently without worrying about the tendency of falling.

The sliding loose-leaf binder can be open or closed by sliding the movable part 12 in or out toward the fixed part 10 along the mating tracks. Owing to the nature of its sliding operation, the present invention virtually eliminates a loud clapping sound normally observed in the conventional O-ring and D-ring binders.

What is claimed is:

1. A sliding loose leaf binder comprised of:

a. a fixed part comprising:

i. a flat elongated first base member having a plurality of mounting apertures, a plurality of first top members of mating tracks, and a plurality of first bottom members of mating tracks;

ii. a plurality of first ring elements fixedly attached to said first base member; and iii. first elements of releasable locking means on each lower and upper end of said first base member; and b. a movable part comprising:

i. a flat elongated second base member having a plurality of second top members of mating tracks, and a plurality of second bottom members of mating tracks;

ii. a plurality of second ring elements fixedly attached to said second base member; and iii. second elements of releasable locking means on each lower and upper end of said second base member;

wherein the mating tracks of the fixed part and the movable part are shaped to complement each other.

2. The sliding loose leaf binder as claimed in claim 1, wherein said first and second base members can preferably be made out of a metal plate of about 0.5 to 3 millimeters thick.

3. The sliding loose leaf binder as claimed in claim 1, wherein said first top member of mating track is flat and rectangular extending horizontally from right end of said first base member to said second base member direction.

4. The sliding loose leaf binder as claimed in claim 1, wherein said second top member of mating track is flat and rectangular extending horizontally from left end of said second base member to said first base member direction.

5. The sliding loose leaf binder as claimed in claim 1, wherein said first bottom member of mating track is flat and rectangular, and about a half of said first bottom member of mating track belongs to said first base member and another half extends horizontally to said second base member direction.

6. The sliding loose leaf binder as claimed in claim 1, wherein said second bottom member of mating track is flat and rectangular, and about a half of said second bottom member of mating track belongs to said second base member and another half extends horizontally to said first base member direction.

7. The sliding loose leaf binder as claimed in claim 1, wherein said second top member of mating track comprises a cylindrical guiding rod at left-center to prevent sidewise shifting of said movable part.

8. The sliding loose leaf binder as claimed in claim 1, wherein said first bottom member of mating track comprises a longitudinal guiding slot and a closed portion.

9. The sliding loose leaf binder as claimed in claim 8, wherein said closed portion catches said guiding rod at fully opened position in order to prevent said movable part from sliding out from said fixed part.

10. The sliding loose leaf binder as claimed in claim 1, wherein said first and second bottom members of mating tracks can preferably be formed by a press machine to a depth of about 0.5 to 3 millimeters below top surfaces of said first and second base members respectively.

11. The sliding loose leaf binder as claimed in claim 1, wherein each of said first element of releasable locking means is flat and rectangular with one rounded corner, and extends vertically from each lower and upper end of said first base member.

12. The sliding loose leaf binder as claimed in claim 1, wherein each of said second element of releasable locking means is flat and rectangular with one rounded corner, and extends vertically from each lower and upper end of said second base member.

13. The sliding loose leaf binder as claimed in claim 1 or 12, wherein said second element of releasable locking means further comprises an elongated boxy shape of swingable engaging means that has side portions and a front portion.

14. The sliding loose leaf binder as claimed in claim 13, wherein said side portion comprises concave dimple on outside surface and convex button on inside surface.

15. The sliding loose leaf binder as claimed in claim 1, wherein said first element of releasable locking means further comprises a receiving aperture arranged to receive convex buttons to secure said swingable engaging means.

* * * * *